US005343923A

United States Patent [19]

Keller

[11] Patent Number: 5,343,923

[45] Date of Patent: Sep. 6, 1994

[54] AUTOMATIC JAMB LATCH MECHANISM FOR OVERHEAD BIFOLD DOOR

[75] Inventor: Daniel N. Keller, River Falls, Wis.

[73] Assignee: Hi-Fold Door Corporation, River Falls, Wis.

[21] Appl. No.: 987,150

[22] Filed: Dec. 8, 1992

Related U.S. Application Data

[63] Continuation-in-part of Ser. No. 653,770, Feb. 11, 1991, Pat. No. 5,168,914.

[51] Int. Cl.[5] ..... E05D 15/26

[52] U.S. Cl. ..... 160/207; 160/213

[58] Field of Search ..... 160/207, 213, 206, 188, 160/189, 193; 292/201, 45, 48

[56] References Cited

U.S. PATENT DOCUMENTS

| | | | |
|---|---|---|---|
| 3,024,838 | 3/1962 | Engleston et al. | 160/193 |
| 3,504,729 | 4/1970 | Alton | 160/188 |
| 4,088,172 | 5/1978 | Pollock | 160/193 |
| 4,177,854 | 12/1979 | DeVore | 160/207 |
| 4,243,091 | 1/1981 | DeVore | 160/189 |
| 4,545,418 | 10/1985 | List et al. | 160/213 |
| 4,609,027 | 9/1986 | Keller | 160/207 |
| 4,637,446 | 1/1987 | McQueen et al. | 160/207 |
| 4,903,747 | 2/1990 | Johnson | 160/117 |
| 5,168,914 | 12/1992 | Keller | 160/207 |

*Primary Examiner*—David M. Purol

*Attorney, Agent, or Firm*—Moore & Hansen

[57] ABSTRACT

A latch assembly for overhead bifold doors. The latch assembly is operated by the same manual or powered winch mechanism that is used to open and close the overhead bifold door. A latch assembly may be mounted to one or both ends of the overhead bifold door, and includes a latch arm that is moved to a latching position at the end of the door closing cycle. A latch member is fixedly positioned to the door jamb adjacent the latch assembly, and when the latch arm is drawn down, the latch member is located between it and the overhead bifold door, causing the overhead bifold door to be securely latched in its closed position until the winch mechanism is activated to begin the overhead bifold door opening cycle.

34 Claims, 5 Drawing Sheets

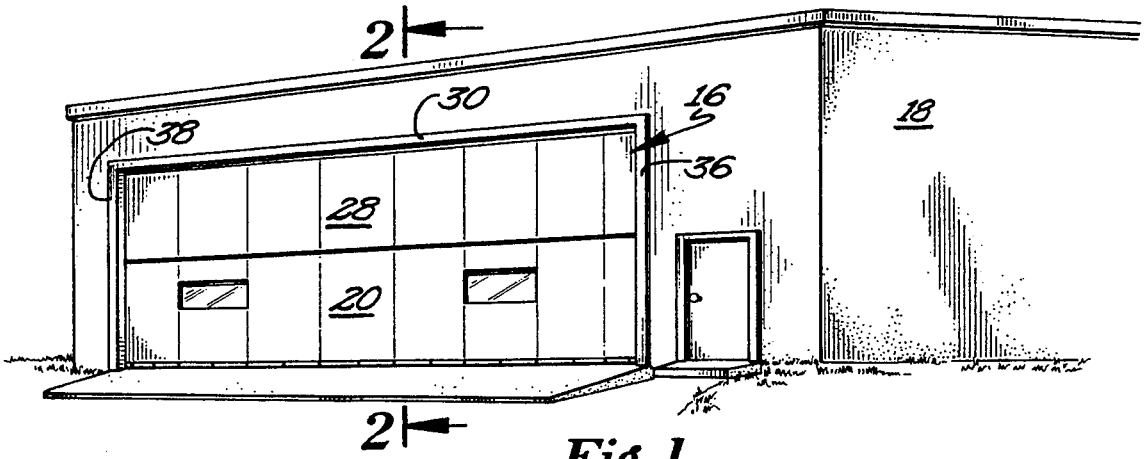
Fig 1
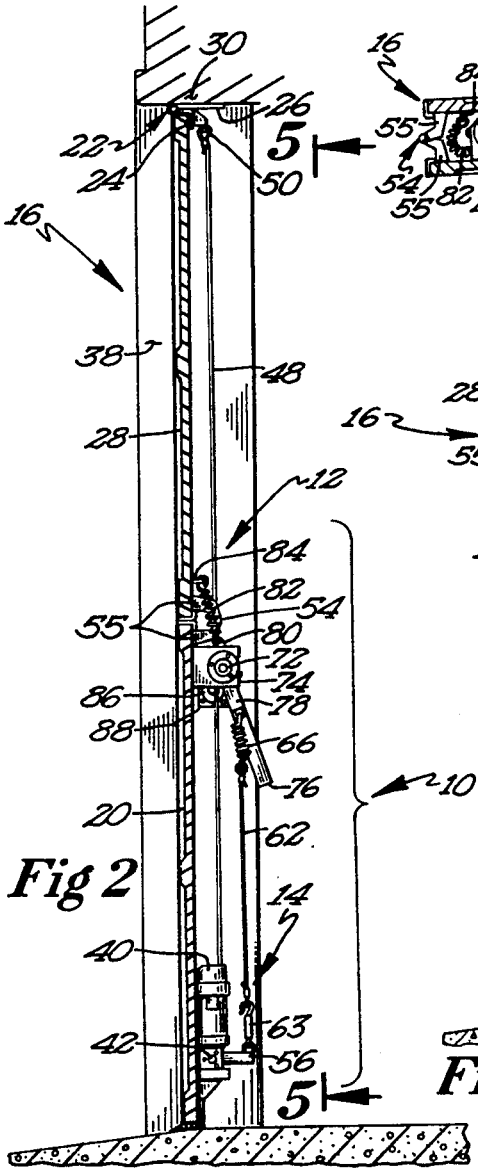
Fig 2
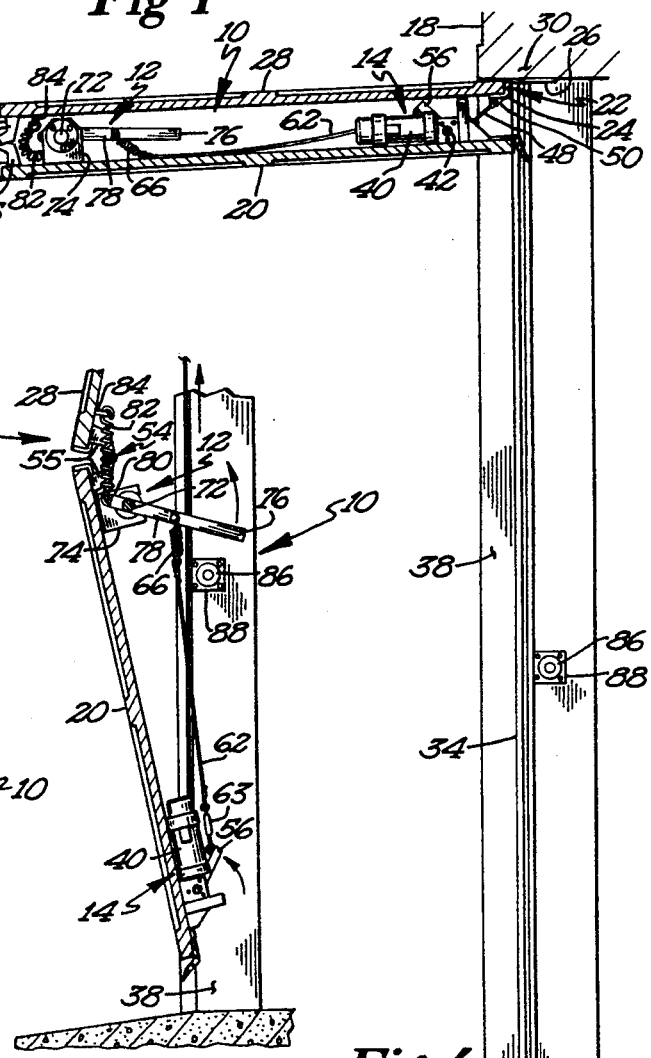
Fig 3
Fig 4

AUTOMATIC JAMB LATCH MECHANISM FOR OVERHEAD BIFOLD DOOR

This is a continuation-in-part of application Ser. No. 07/653,770, filed Feb. 11, 1991 now U.S. Pat. No. 5,168,914.

BACKGROUND OF THE INVENTION

1. Technical Field

The present invention relates generally to latching mechanisms for overhead doors, particularly for those overhead doors with a bifold construction.

2. Background Information

A typical overhead bifold door assembly, such as that described in U.S. Pat. No. 4,609,027, issued to Keller on Sep. 2, 1986, includes an upper door panel and a lower door panel, with the upper door panel hingedly connected to the lintel or header of the door frame. When in its first, closed position, the panels of the overhead door are vertically aligned and cooperate to close the doorway, while in its second, open position the panels of the overhead door are in a folded, generally horizontal, parallel relation. Generally, a door of the size contemplated by the present invention is movable by a winch mounted to the lower door panel, with the winch having a cable extending to a fixed location above the doorway for vertically raising and lowering the bottom edge of the lower door panel and bringing the overhead door to its closed position.

Various systems have been developed to address the need for a locking mechanism that will securely lock the panels in their closed, vertically aligned position. In the above-mentioned U.S. Pat. No. 4,609,027 issued to Keller, the weight of the motor and winch mounted on the lower door panel were relied on to act as an anchor to provide dead weight to help keep the door closed. However, such an arrangement would not necessarily provide the affirmative latching action desired to maintain securely the overhead door in its closed position.

An example of a latching system is disclosed in U.S. Pat. No. 4,903,747 issued to Johnson on Feb. 27, 1990. The system disclosed in this patent, however, is directed to a device usable with a pair of relatively small, vertically disposed left and right bifold door assemblies used as closet doors, window shutters, or the like, and cooperates with the inner panels of the two bifold door assemblies. Further, the system disclosed in this patent does not operate automatically as a part of the door opening and closing operation.

Another example of a latching mechanism is disclosed in U.S. Pat. No. 4,637,446 issued to McQueen et al. on Jan. 20, 1987, which shows a spring biased latching system. The system disclosed in this patent shows a latch member that engages a catchplate mounted on the door track. Opening and closing of the door is done manually, however, with a lift cable being used to disengage the latch member from the catchplate.

The automatic latching mechanism of the present invention overcomes the difficulties described above and affords other features and advantages heretofore not available.

SUMMARY OF THE INVENTION

The invention includes a latching assembly and an activation assembly. The latching assembly includes a latch arm that cooperates with a latch member fixed to an adjacent door jamb. The actuation assembly is driven by an electric motor that also serves to open and close the overhead bifold door. As the bifold door reaches its vertical, closed position, the actuation assembly pulls a cable that overcomes the resistance of a backspring, allowing the latch arm to be pulled into a locking relationship with the roller fixed to the door jamb.

It is an object of the invention to provide a secure latching mechanism for very large size overhead bifold doors. It is a further object of the invention to provide a latching mechanism that performs the unlatching and latching operations automatically in cooperation with the opening and closing of the overhead bifold door.

It is a further object of the invention that the entire opening, closing and latching operations be performed automatically by engaging a single electric motor.

Other objects and advantages of the invention will become apparent from the following detailed description and from the appended drawings in which like numbers have been used to describe like parts throughout the several views.

BRIEF DESCRIPTION OF THE DRAWINGS

FIG. 1 shows a perspective view of the outside of a typical structure having an overhead bifold door in its vertical, closed position;

FIG. 2 shows a cutaway view taken along line 2—2 of FIG. 1 showing an end view of the automatic jamb latch mechanism in the fully latched position;

FIG. 3 shows a view similar to that of FIG. 2 but with the door somewhat opened and the automatic jamb latch in the unlatched position, including a partially cutaway view of the latch assembly;

FIG. 4 shows a view similar to that of FIG. 3 but with the overhead bifold door in its fully open position;

DESCRIPTION OF THE PREFERRED EMBODIMENT

Figure 5:
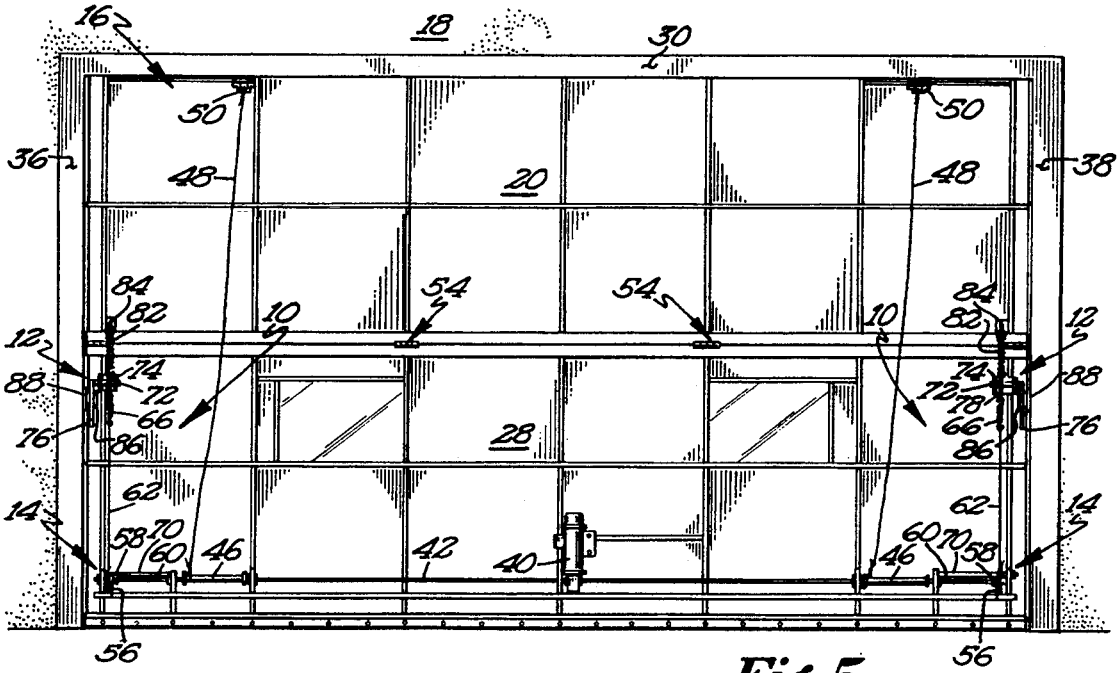
FIG. 5 shows a rear view of the overhead bifold door in its closed, vertical position, with an automatic jamb latch mechanism installed on both ends of the overhead bifold door.
Figure 8:
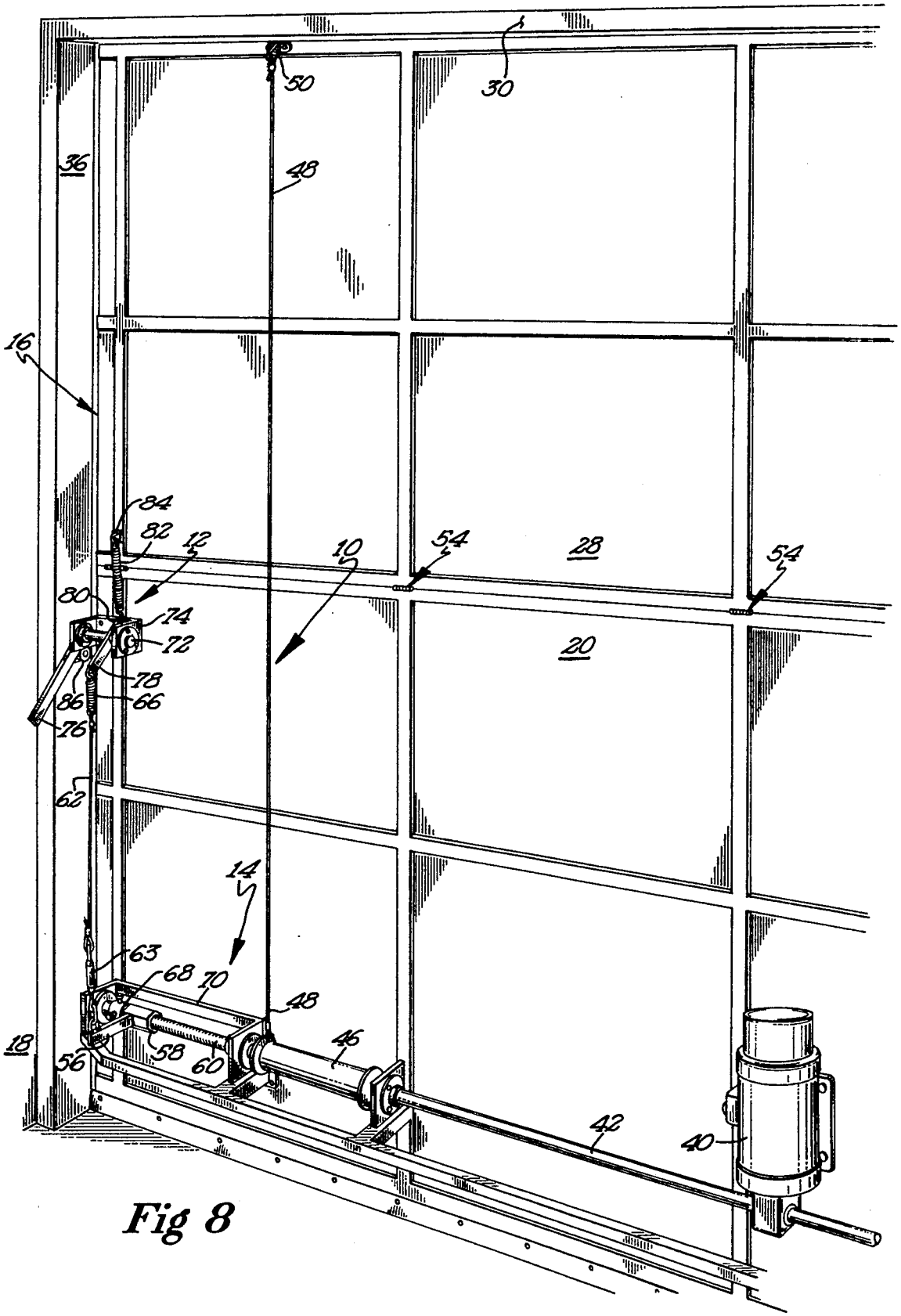
FIG. 8 shows a perspective view of the automatic jamb latch mechanism mounted on an overhead bifold door with the door in its vertical, closed position and the latch in its latched position.

With reference to the drawings, and in particular to FIG. 8, the automatic jamb latch mechanism for an overhead bifold door is generally indicated by reference numeral 10. Jamb latch mechanism 10 includes a latch arm assembly 12 and an actuation assembly 14. In its preferred embodiment, jamb latch mechanism 10 is mounted on the inside surface of an overhead bifold door 16 covering an opening to a garage or other utility building 18 (FIG. 1). Jamb latch mechanism 10 is preferably mounted to the first or lower panel 20 of overhead bifold door 16, although embodiments are envisioned that include a jamb latch mechanism 10 on both panels of overhead door 16. Further, jamb latch mechanism 10 may include latch arm assemblies 12 located on both ends of overhead bifold door (FIG. 5), in which case actuation assemblies 14 are required for each latch arm assembly 12. Yet a third latch arm assembly 12 may be provided, mounted to the upper panel 28 of overhead bifold door 16. A third latch arm assembly 12 so described may be actuated by means of an actuation assembly 14 already provided for one of the first two latch arm assemblies 12.

Overhead bifold door 16 may be attached to building 18 by any number of means, including by hinge means 22 that includes first attachment plate 24 and second attachment plate 26, as shown in FIGS. 2 and 4. First attachment plate 24 is fixedly attached as by screws to the second or upper panel 28 of overhead bifold door 16, and second attachment plate 26 is fixedly attached as by screws to the lintel or horizontal header 30. In the embodiment shown, both lower corners of lower panel 20 include projecting therefrom rollers 32 that ride within tracks 34. One track 34 is mounted to first door jamb 36 and the other track 34 is mounted to second door jamb 38.

As shown in FIG. 8, an electric motor 40 is mounted to lower panel 20 of overhead bifold door 16. The preferred embodiment of this device includes motor 40 to raise and lower overhead bifold door 16, although a manual winch system may be substituted for the motor. Further, motor 40 may be mounted to upper panel 28, lintel 30 or an interior wall portion of building 18 above or otherwise adjacent to overhead bifold door 16. Overhead bifold door 16 is raised when a switch mounted on an interior wall surface of building 18 is turned to start motor 40. Motor 40 then rotates power shaft 42 in the direction of arrow 44 (FIG. 6), which in turn rotates take-up shaft 46, which is a coaxial extension of power shaft 42. Take-up cable 48, an end of which may be fixedly attached to an upper portion of overhead bifold door 20, as at hook 50 projecting from first attachment plate 24 (FIGS. 2, 4, 5 and 8), is then wound around take-up shaft 46, and the lower edge of overhead bifold door 16 is raised in the direction of arrow 52 (FIG. 6), causing panels 20 and 28 to fold about hinges 54, fastened to upper panel 28 and lower panel 20. Hinge means 54 may include a pivot extending inward from the panels, mounted to hinge extension brackets 55 (FIGS. 2–4), as taught in U.S. Pat. No. 4,609,027, issued to Keller on Sep. 2, 1986. Such a modification serves to maximize the clearance between overhead bifold door 16 and the surface beneath, such as a garage floor, when overhead bifold door 16 is in its fully open position as shown in FIG. 4 by permitting lower door panel 20 and upper door panel 28 to approach a generally parallel relationship when open.

Figure 6:
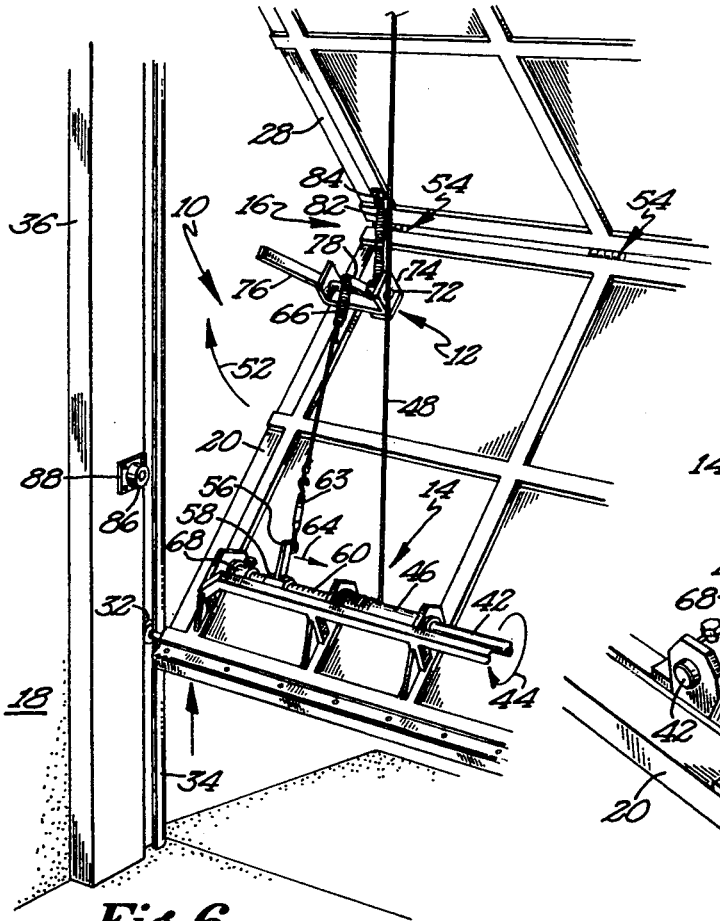
FIG. 6 shows a rear perspective view of the automatic jamb latch mechanism mounted on an overhead bifold door as the door is being opened.
Figure 7:
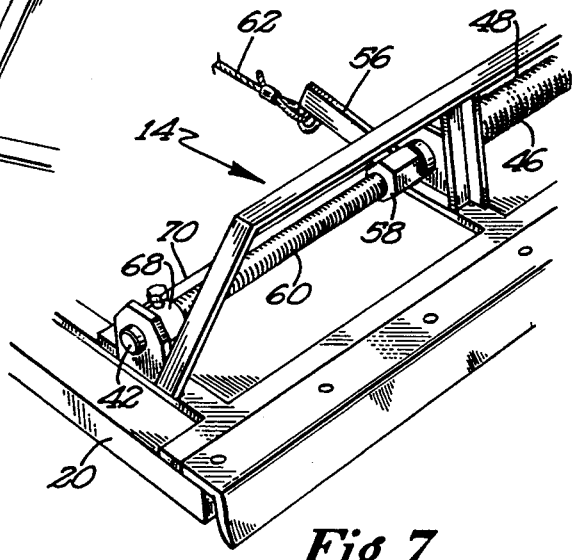
FIG. 7 shows a fragmentary, perspective view of the actuation assembly of the automatic jamb latch mechanism.

Actuation assembly 14 of jamb latch mechanism 10 also uses motor 40 to actuate latch arm assembly 12. As shown in FIGS. 6–8, actuation assembly 14 includes an arm 56 projecting from a threaded nut 58. Threaded nut 58 is threadedly engaged with threaded rod 60, a coaxial extension of power shaft 42 and take-up shaft 46. Thus, as motor 40 rotates power shaft 42 and take-up shaft 46, it simultaneously rotates threaded rod 60. Each of these three rod segments—i.e., power shaft 42, take-up shaft 46 and threaded rod 60—rotates in the same direction, as, for example, indicated by direction arrow 44. To the end of arm 56 is attached connecting means 62, the other end of which is attached to latch arm assembly 12. With overhead bifold door 16 in its open position (FIG. 4), motor 40 rotates power shaft 42 in the direction opposite to that indicated by direction arrow 44 (FIG. 6) to bring overhead bifold door 16 to its closed position. As threaded rod 60 rotates, threaded nut 58 moves along rod 60 in a direction opposite to that indicated by direction arrow 64 (FIG. 6), moving, for example, from right to left when configured as illustrated in FIG. 6. Arm 56 is maintained in its upward extending position as it travels along threaded rod 60, as shown, for example, in FIG. 6, because of the upward tension caused by coil spring member 66, integral with connecting means 62. (Connecting means 62 also preferably includes a metal cable, and may further include an adjustment leader 63 permitting the length of connecting means 62 to be easily lengthened or shortened.) Upon reaching the end of threaded rod 60, threaded nut 58 encounters stop 68, which is fixedly attached to and rotates with threaded rod 60. Stop 68, also coaxial with power shaft 42, now causes threaded nut 58 to rotate with threaded rod 60 approximately one quarter to one half rotation, which in turn causes arm 56 to rotate downwardly to the position shown in FIG. 8. The length of travel of threaded nut 58 along threaded rod 60 is so measured that threaded nut 58 encounters and travels with stop 68 at the very end of the closing cycle of overhead bifold door 16. As will be described hereinafter, the rotation of threaded nut 58 and the resulting travel of arm 56, which overcomes the resistance of coil spring member 66, actuates latch arm assembly 12, causing overhead bifold door 16 to become securely locked in a closed position, as shown in FIG. 8.

Upon beginning the cycle that results in moving overhead bifold door 16 to the open position, motor 40 rotates power shaft 42 in the direction indicated by arrow 44, causing threaded rod 60 also to rotate in the direction indicated by arrow 44. Threaded nut 58 and arm 56 also rotate with threaded rod 60, until arm 56 contacts bumper plate 70 (FIGS. 7 and 8). Upon striking bumper plate 70, arm 56 and threaded nut 58 therewith break contact with stop 68, and thereafter travel along threaded rod 60 in the direction indicated by arrow 64 (FIG. 6). As threaded nut 58 and arm 56 rotate with stop 68 to the position indicated in FIG. 6, latch arm assembly 12 is released, and overhead bifold door 16 is free to move to its open position. (See, FIGS. 2–4.)

Referring to FIGS. 6 and 8, latch arm assembly 12 includes a latch shaft 72 rotatably mounted to latch bracket 74, which is fixedly attached to lower panel 20 near first or second door jamb 36, 38, to maintain a distance of at least 1½ to two inches between latch shaft 72 and any structure immediately behind it, such as lower panel 20 or the front of any lateral portion such as a crossbar on latch bracket 74. An end of latch shaft 72, this being the end thereof nearest the adjacent door jamb 36, 38, projects beyond the projecting portions of latch bracket 74, and mounted to this end is latch arm 76. Also mounted to latch shaft 72, between the projecting portions of latch bracket 74 to which latch shaft 72 is mounted, are oppositely extending first tensioning arm 78 and second tensioning arm 80, most clearly shown in FIG. 3. The second or upper end of connecting means 62 is attached to first tensioning arm 78. In the preferred embodiment, first tensioning arm 78 is generally parallel to latch arm 76, but this is not required for the proper operation of latch arm assembly 12. Second tensioning arm 80 preferably projects generally rearwardly from latch shaft 72, and attached to a receiving portion thereon spaced from latch shaft 72, near the end of second tensioning arm 80, is an end of backspring 82. The second end of backspring 82 is attached to anchor 84, which, in its preferred embodiment, is fixedly mounted to upper door panel 28. Alternatively, anchor 84 may be attached to lower door panel 20. However, when so attached backspring 82 exerts a rearward force on second tensioning arm 80, resulting in the outward projection of latch arm 76, which, when overhead bifold door 16 is being opened, may cause damage to upper panel 28 unless a special deflecting plate (not shown) is added.

Attached to the door jamb 36, 38 adjacent latch arm assembly 12 for cooperative engagement therewith is a latch member that may preferably take the form of a rotatable metal roller 86. In the preferred embodiment, roller 86 is mounted to a roller shaft (not shown) projecting from a plate 88.

Figure 9:
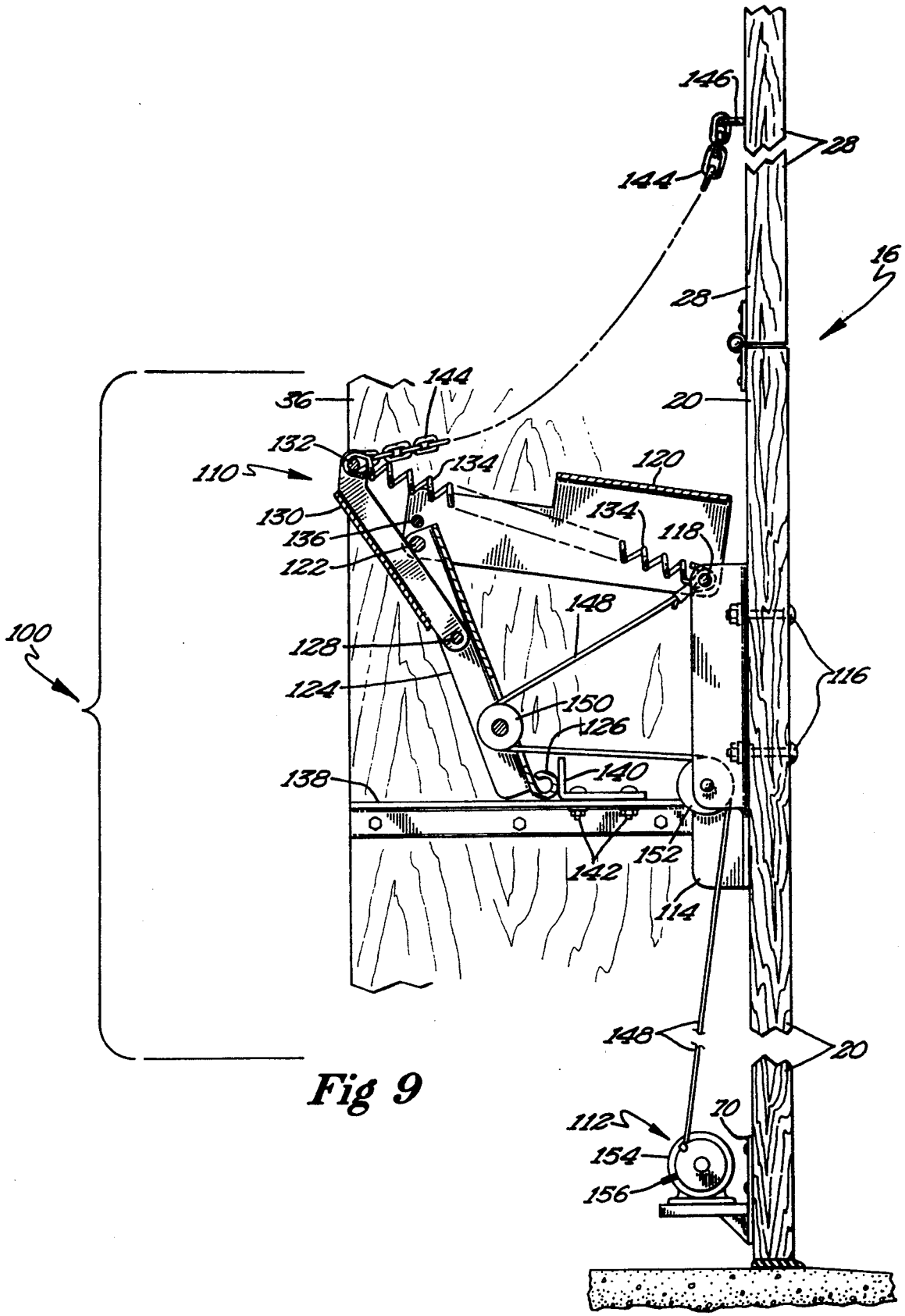
FIG. 9 shows a fragmentary, side section view of a modified embodiment of the apparatus in the closed, latching position.
Figure 10:
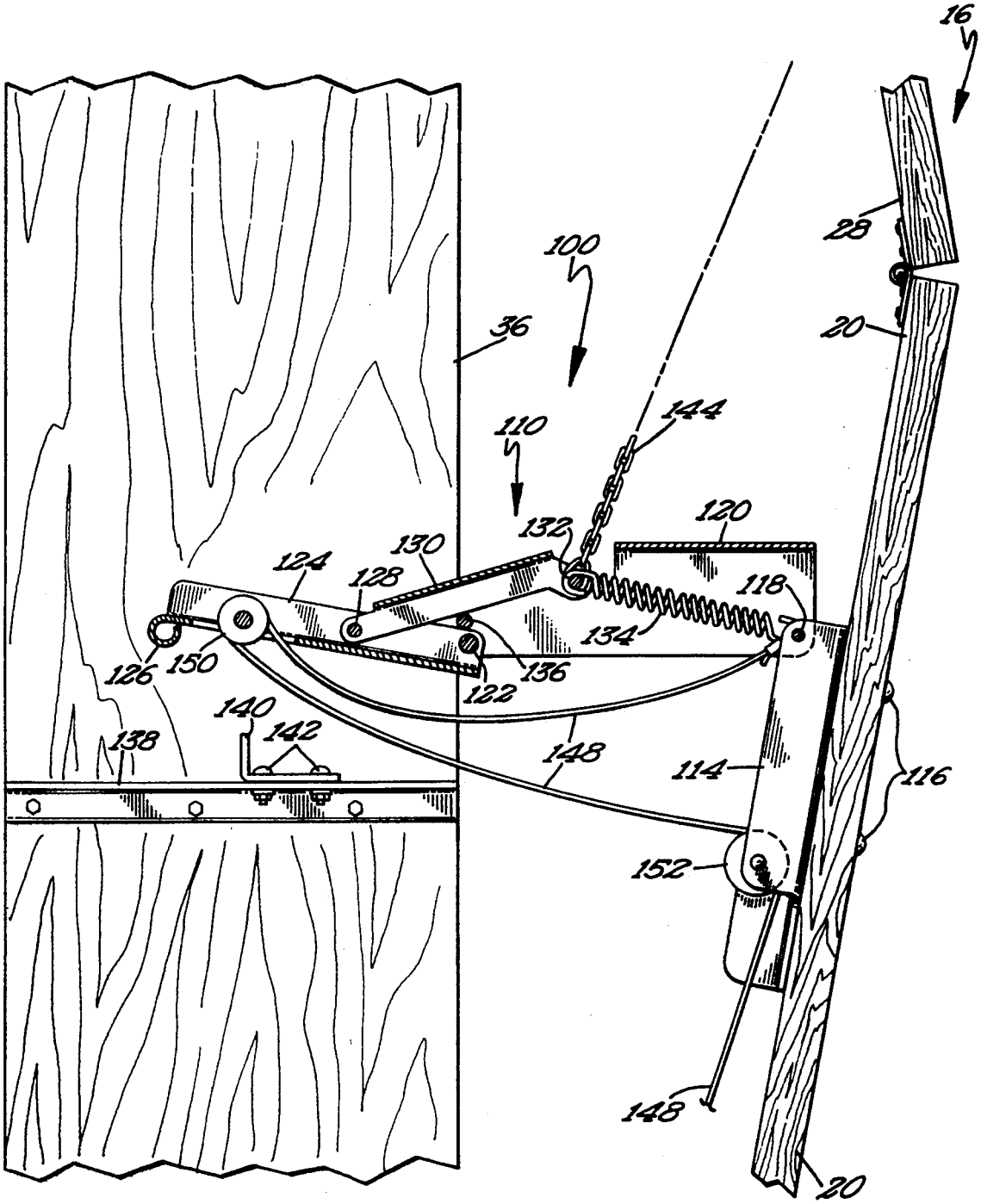
FIG. 10 shows a side section view of the modified embodiment of the apparatus illustrated in FIG. 9 in the open, unlatched position.

With reference to FIGS. 9 and 10, an alternative embodiment of the jamb latch mechanism is disclosed that is generally indicated by reference numeral 100. Jamb latch mechanism 100 includes latch arm assembly 110 and actuation assembly 112.

Alternative latch arm assembly 110 includes base channel 114 mounted to lower door panel 20 of overhead bifold door 16 as by bolts 116. Hingedly connected to an end of base channel 114, as by first hinge pin 118, is an end of pivot channel 120. Hingedly connected to the opposite end of pivot channel 120, as by second hinge pin 122, is an end of hook channel 124. The opposite end of hook channel 124 includes a generally blunt, or hook, portion 126. Also, hingedly connected to an intermediate portion of hook channel 124, as by a third hinge pin 128, is an end of rocker arm 130. As may be seen with reference to FIGS. 9 and 10, at least a substantial portion of each of pivot channel 120, hook channel 124 and rocker arm 130, as well as base channel 114, forms a channel between the two sides of which are positioned the various hinge pins. For example, first hinge pin 118 extends through the two sides of the channels formed by base channel 114 and pivot channel 120. Similarly, second hinge pin 122 extends through the two sides of the channels formed by pivot channel 120 and hook channel 124, and third hinge pin 128 extends through the two sides of the channels formed by hook channel 124 and rocker arm 130. As is most apparent with reference to FIG. 10, pivot channel 120, hook channel 124 and rocker arm 130 combine to form a movable latch arm.

Fastened to anchor pin 132 extending between the two sides of rocker arm 130 is an end of spring member 134, the opposite end of which is fastened to first hinge pin 118. Spring member 134 tends to pull the end of rocker arm 130 that includes anchor pin 132 toward first hinge pin 118. When in the closed position illustrated in FIG. 9, rocker arm 130 bears against second hinge pin 122. When in the open position illustrated in FIG. 10, lever arm 130 bears against pivot pin 136.

As may be seen in FIG. 9, hook portion 126 of hook channel 124 bears against angle iron 138, to which is mounted movable strike 140. Strike 140 is fastened as by bolts 142 to angle iron 138, which is attached to first door jamb 36. It is preferred to provide a slot in angle iron 138 (not shown) to permit strike 140 to be repositioned along the length of angle iron 138 to promote more secure closing of bifold door 16, as shall be explained. It should be noted that although latch arm assembly 110 is illustrated in FIGS. 9 and 10 as mounted to cooperate with first door jamb 36, the assembly may be mounted alternatively or additionally to cooperate with second door jamb 38, as is also the case with latch arm assembly 12.

Also attached to anchor pin 132 is an end of chain 144 that anchors on its opposite end as by anchor hook 146 to second, upper panel 28 of bifold door 16. Chain 144 raises latch arm assembly 110 to approximately the position illustrated in FIG. 10 as bifold door 16 approaches the closed position illustrated in FIG. 9.

Also attached to first hinge pin 118 is an end of a connecting means in the form of cable 148. As shown, cable 148 winds around first pulley 150 positioned between the two sides of the channel formed by hook channel 124, and then passes around second pulley 152 positioned between the two sides of the channel formed by base channel 114. As shown in FIG. 9, cable 148 then extends down to actuation assembly 112, where it attaches to cylinder 154. Actuation assembly 112 is very similar to actuation assembly 14, except that cylinder 154, with cylinder stop 156, is mounted to threaded nut 58 in place of arm 56. As with arm 56, cylinder stop 156 encounters bumper plate 70, which may also comprise a strip of angle iron fastened along lower panel 20 of bifold door 16. Actuation assembly 112 also includes take-up shaft 46 attached to take-up cable 48, all of which is mounted to power shaft 42, similar to actuation assembly 14. It should be noted that either actuation assembly 112 or 14 may be used with latch arm assembly 110, and that the same applies to latch arm assembly 12.

In use, electric motor 40 of jamb latch mechanism 10 is activated, for example, by a wall-mounted switch (not shown) located on an interior wall surface of building 18. Assuming overhead bifold door 16 is in the open position, as indicated in FIG. 4, power shaft 42 rotates in a direction opposite to that indicated by arrow 44 in FIG. 6, causing take-up cable 48 to be unwound from take-up shaft 46. Simultaneously, threaded nut 58 is in the position illustrated in FIG. 7 when overhead bifold door 16 is in its open position, and the rotation of power shaft 42 causes threaded rod 60 to rotate in the same direction. The rotation of threaded rod 60, combined with the upward directed tension of spring member 66 of connecting means 62 attached to arm 56 of threaded nut 58, causes threaded nut 58 to move along threaded rod 60 toward stop 68. In the case of actuation assembly 112, the extension of latch arm assembly 110, as illustrated in FIG. 10, while overhead bifold door 16 is in the open position, results in cylinder stop 156 of cylinder 154 maintaining its position bearing against bumper plate 70.

As overhead bifold door 16 completes the closing cycle, threaded nut 58 contacts stop 68, causing threaded nut 58 to rotate with threaded rod 60 approximately one quarter to one half rotation. Electric motor 40 then stops running, as overhead bifold door 16 is now closed. However, as threaded nut 58 rotates with threaded rod 60 after contacting stop 68, arm 56 pulls down on connecting means 62, overcoming the upward directed tension of spring member 66 and backspring 82. The downward motion of arm 56 overcomes the resistance of backspring 82 and causes a similar downward motion in first tensioning arm 78, resulting in the rotation of latch shaft 72, causing the upward motion of second tensioning arm 80 and the corresponding downward motion of latch arm 76. The downward motion of latch arm 76 to the position shown in FIG. 8 completes the latching cycle of latch arm assembly 12. With roller 86 now positioned between latch arm 76 and lower panel 20 of overhead bifold door 16, overhead bifold door 16 is securely prevented from opening until motor 40 is reactivated, starting the opening cycle of overhead bifoid door 16. In the case of latch arm assembly 110 and actuation assembly 112, as threaded nut 58 rotates with threaded rod 60 after contacting stop 68, cylinder 154 pulls down on cable 148. This causes first pulley 150 to be drawn toward second pulley 152, overcoming the resistance of spring member 134, with hook portion 126 of hook channel 124 being drawn along angle iron 138 toward strike 140. With hook portion 126 of hook channel securely positioned against strike 140, overhead bifold door 16 is securely prevented from opening until motor 40 is reactivated, starting the opening cycle of overhead bifold door 16.

The opening cycle of overhead bifold door 16 is largely the reverse of the closing cycle, with motor 40 rotating power shaft 42 in the direction indicated by arrow 44 in FIG. 6, causing take-up cable 48 to be wound onto take-up shaft 46. It is important to note that upon the first one quarter to one half rotation of threaded nut 58, until arm 56 contacts bumper plate 70, it is the tension of backspring 82 pulling down on second tensioning arm 80 that causes latch arm 76 to rise from the position shown in FIG. 2 to the position shown in FIG. 3, thus permitting overhead bifoid door 16 to return to its open position. Further, as overhead bifold door 16 approaches the fully open position illustrated in FIG. 4, the tension in backspring 82 is relaxed, allowing latch arm 76 to settle generally parallel to lower and upper door panels 20, 28, respectively. In the case of latch arm assembly 110 and actuation assembly 112, upon the rotation of power shaft 42, cylinder 154 rotates until cylinder stop 156 contacts bumper plate 70, removing the tension on cable 148 and permitting spring member 134 to draw hook portion 126 of hook channel 124 away from strike 140. Spring member 134 continues to contract until latch arm assembly 110 reaches the position illustrated in FIG. 10, permitting clear and easy opening of overhead bifold door 16.

While the preferred embodiments of the invention have been described, it should be understood that various changes, adaptations, and modifications may be made therein without departing from the spirit of the invention and the scope of the appended claims.

What is claimed is:

1. A latch mechanism for use with and attachable to an overhead bifold door movable between open and closed positions over a doorway, the doorway having a first door jamb and a second door jamb and the overhead bifold door having a first door panel and a second door panel hingedly attached to each other, the latch mechanism comprising:

a latch arm assembly, including a movable latch arm and biasing means, attachable to the first door panel of the overhead bifold door adjacent the first door jamb of the doorway, said latch arm assembly having a first, latched position and a second, unlatched position of said latch arm, said latch arm including a first member, a second member and a third member, said second member being pivotally attached to said first member, and said third member being pivotally attached to said second member;

a latch member attachable to the first door jamb, and positioned for selective, cooperative engagement with said second member of said latch arm;

actuation means attachable to the first door panel of the overhead bifold door for operative activation of said latch arm assembly between said latched and unlatched positions and for moving said latch arm into latching relation to said latch member;

connecting means linking said actuation means and said latch arm assembly;

a power source for driving the latch mechanism; and power transmission means between said power source and said actuation means.

2. The latch mechanism as recited in claim 1, wherein said power source is a motor.

3. The latch mechanism as recited in claim 2, wherein:

said motor is mounted to the first door panel of the overhead bifold door.

4. A latch mechanism for use with and attachable to an overhead bifold door movable between open and closed positions over a doorway, the doorway having a first door jamb and a second door jamb and the overhead bifold door having a first door panel and a second door panel hingedly attached to each other, the latch mechanism comprising:

a latch arm assembly, including a movable latch arm and biasing means, attachable to the first door panel of the overhead bifold door adjacent the first door jamb of the doorway, said latch arm assembly having a first, latched position and a second, unlatched position of said latch arm, said latch arm assembly further comprising:

a base member mounted on the first door panel of the overhead bifold door;

a pivot member attachable to said base member;

a hook member attachable to said pivot member; and a rocker arm attachable to said pivot member and said hook member;

a latch member attachable to the first door jamb, and positioned for selective, cooperative engagement with said latch arm;

actuation means attachable to the first door panel of the overhead bifold door for operative activation of said latch arm assembly between said latched and unlatched positions and for moving said latch arm into latching relation to said latch member;

connecting means linking said actuation means and said latch arm assembly;

a power source for driving the latch mechanism; and power transmission means between said power source and said actuation means.

5. The latch mechanism as recited in claim 1, wherein:

said first member of said latch arm is a pivot member;

said second member of said latch arm is a hook member; and said third member of said latch arm is a rocker arm.

6. A latch mechanism as recited in claim 1, wherein said latch arm assembly further comprises:

a base member attachable to the first door panel of the overhead bifold door.

7. A latch mechanism as recited in claim 6, wherein:

said first member of said latch arm is a pivot member;

said second member of said latch arm is a hook member; and said third member of said latch arm is a rocker arm having a first end and a second end.

8. A latch mechanism as recited in claim 7, further comprising:

a first hinge pin hingedly connecting said pivot member to said base member;

a second hinge pin hingedly connecting said hook member to said pivot member; and a third hinge pin hingedly connecting said rocker arm to said hook member.

9. A latch mechanism as recited in claim 8, wherein:

said biasing means is operatively associated with said latch arm and normally biases said latch arm to said unlatched position wherein said latch arm is held out of latching relation to said latch member, and said connecting means being operatively connected to said latch member to overcome said biasing means in response to operation of said actuation means to rotate said latch arm to said latched position.

10. A latch mechanism as recited in claim 9, wherein:

said third hinge pin is attached to said first end of said rocker arm;

said rocker arm includes an anchor pin attached to said second end thereof;

said biasing means is a spring having a first end and a second end, said first end of said spring being attached to said anchor pin and said second end of said spring being attached to said first hinge pin.

11. A latch mechanism as recited in claim 1, wherein:

said biasing means is operatively associated with said latch arm and normally biases said latch arm to said unlatched position wherein said latch arm is held out of latching relation to said latch member, and said connecting means being operatively connected to said latch member to overcome said biasing means in response to operation of said actuation means to rotate said latch arm to said latched position.

12. A latch mechanism as recited in claim 1, wherein:

said power transmission means includes a power shaft having a first end and a second end, said first end of said power shaft being connected to said power source; and said actuation means is mounted to said second end of said power shaft.

13. A latch mechanism as recited in claim 12, wherein said actuation means comprises:

a cylindrical threaded portion having a first end and a second end, said cylindrical threaded portion being coaxial with said power shaft;

a threaded nut that travels along said cylindrical threaded portion;

a connecting arm projecting from said threaded nut, said connecting arm being attached to said connecting means; and a stopping segment near an end of said cylindrical threaded portion, whereby when said power shaft rotates, said threaded nut travels along said cylindrical threaded portion until it confronts said stopping segment, after which said threaded nut rotates with said power shaft.

14. A latch mechanism as recited in claim 8, further comprising:

a first pulley member rotatably attached to said latch arm; and a second pulley member rotatably attached to said base member.

15. A latch mechanism as recited in claim 14, wherein:

said connecting means is a cable having a first end, a second end and an intermediate portion; and said first end of said cable is attached to said first hinge pin, said second end of said cable is attached to said actuation means, and said intermediate portion of said cable engages said first pulley member and said second pulley member.

16. A latch mechanism as recited in claim 15, wherein:

said first pulley member is rotatably attached to said hook member.

17. A latch mechanism as recited in claim 12, wherein said actuation means comprises:

a cylindrical threaded portion having a first end and a second end, said cylindrical threaded portion being coaxial with said power shaft;

a threaded nut that travels along said cylindrical threaded portion;

a cylinder member mounted to said threaded nut, said cylinder member including a cylinder stop projecting therefrom; and a stopping segment near an end of said cylindrical threaded portion, whereby when said power shaft rotates, said threaded nut travels along said cylindrical threaded portion until it confronts said stopping segment, after which said threaded nut rotates with said power shaft.

18. A latch mechanism as recited in claim 1, further comprising:

latch arm assembly raising means, whereby said latch arm assembly is raised to a position when the overhead bifold door is moving between the open and closed positions that assures easy clearance of said latch member.

19. A latch mechanism as recited in claim 18, wherein said latch arm assembly raising means comprises:

an anchor member fixedly attached to the second door panel of the overhead bifold door; and a connecting member having a first end and a second end, said first end of said connecting member being fixedly attached to said anchor member and said second end of said connecting member being fixedly attached to said third member of said latch arm.

20. A latch mechanism as recited in claim 19, wherein:

said connecting member is a chain.

21. A latch mechanism as recited in claim 4, wherein:

the power source is a motor.

22. A latch mechanism as recited in claim 21, wherein:

said motor is mounted to the first door panel of the overhead bifold door.

23. A latch mechanism as recited in claim 4, wherein:

a first hinge pin hingedly connecting said pivot member to said base member;

a second hinge pin hingedly connecting said hook member to said pivot member; and a third hinge pin hingedly connecting said rocker arm to said hook member.

24. A latch mechanism as recited in claim 23, wherein:

said biasing means is operatively associated with said latch arm and normally biases said latch arm to said unlatched position wherein said latch arm is held out of latching relation to said latch member, and said connecting means being operatively connected to said latch member to overcome said biasing means in response to operation of said actuation means to rotate said latch arm to said latched position.

25. A latch mechanism as recited in claim 24, wherein:

said third hinge pin is attached to said first end of said rocker arm;

said rocker arm includes an anchor pin attached to said second end thereof;

said biasing means is a spring having a first end and a second end, said first end of said spring being attached to said anchor pin and said second end of said spring being attached to said first hinge pin.

26. A latch mechanism as recited in claim 4, wherein:

said biasing means is operatively associated with said latch arm and normally biases said latch arm to said unlatched position wherein said latch arm is held out of latching relation to said latch member, and said connecting means being operatively connected to said latch member to overcome said biasing means in response to operation of said actuation means to rotate said latch arm to said latched position.

27. A latch mechanism as recited in claim 4, wherein:

said power transmission means includes a power shaft having a first end and a second end, said first end of said power shaft being connected to said power source; and said actuation means is mounted to said second end of said power shaft.

28. A latch mechanism as recited in claim 27, wherein said actuation means comprises:

a cylindrical threaded portion having a first end and a second end, said cylindrical threaded portion being coaxial with said power shaft;

a threaded nut that travels along said cylindrical threaded portion;

a connecting arm projecting from said threaded nut, said connecting arm being attached to said connecting means; and a stopping segment near an end of said cylindrical threaded portion, whereby when said power shaft rotates, said threaded nut travels along said cylindrical threaded portion until it confronts said stopping segment, after which said threaded nut rotates with said power shaft.

29. A latch mechanism as recited in claim 26, further comprising:

a first pulley member rotatably attached to said latch arm; and a second pulley member rotatably attached to said base member.

30. A latch mechanisms as recited in claim 29, wherein:

said connecting means is a cable having a first end, a second end and an intermediate portion; and said first end of said cable is attached to said first hinge pin, said second end of said cable is attached to aid actuation means, and said intermediate portion of said cable engages said first pulley member and said second pulley member.

31. A latch mechanism as recited in claim 30, wherein:

said first pulley member is rotatably attached to said hook member.

32. A latch mechanism as recited in claim 27, wherein said actuation means comprises:

a cylindrical threaded portion having a first end and a second end, said cylindrical threaded portion being coaxial with said power shaft;

a threaded nut that travels along said cylindrical threaded portion;

a cylinder member mounted to said threaded nut, said cylinder member including a cylinder stop projecting therefrom; and a stopping segment near an end of aid cylindrical threaded portion, whereby when said power shaft rotates, said threaded nut travels along said cylindrical threaded portion until it confronts said stopping segment, after which said threaded nut rotates with said power shaft.

33. A latch mechanism as recited in claim 4, further comprising:

latch arm assembly raising means, whereby said latch arm assembly is raised to a position when the overhead bifold door is moving between the open and closed positions that assures easy clearance of said latch member.

34. A latch mechanism as recited in claim 33, wherein said latch arm assembly raising means comprises:

an anchor member fixedly attached to the second door panel of the overhead bifold door; and a chain having a first end and a second end, said first end of said chain being fixedly attached to said anchor member and said second end of said chain being fixedly attached to said rocker arm.

* * * * *